US008157527B2

(12) United States Patent
Piggush et al.

(10) Patent No.: US 8,157,527 B2
(45) Date of Patent: Apr. 17, 2012

(54) AIRFOIL WITH TAPERED RADIAL COOLING PASSAGE

(75) Inventors: Justin D. Piggush, Hartford, CT (US); William Abdel-Messeh, Middletown, CT (US)

(73) Assignee: United Technologies Corporation, Hartford, CT (US)

( * ) Notice: Subject to any disclaimer, the term of this patent is extended or adjusted under 35 U.S.C. 154(b) by 914 days.

(21) Appl. No.: 12/167,435

(22) Filed: Jul. 3, 2008

(65) Prior Publication Data

US 2010/0003142 A1 Jan. 7, 2010

(51) Int. Cl.
*F01D 5/20* (2006.01)

(52) U.S. Cl. ..... 416/97 R

(58) Field of Classification Search ..... 415/115, 415/175–176; 416/95–96 A
See application file for complete search history.

(56) References Cited

U.S. PATENT DOCUMENTS

| | | | | |
|---|---|---|---|---|
| 3,051,439 | A * | 8/1962 | Hilton | 416/97 R |
| 3,334,685 | A * | 8/1967 | Burggraf et al. | 165/104.25 |
| 3,978,731 | A | 9/1976 | Reeder et al. | |
| 4,500,258 | A * | 2/1985 | Dodd et al. | 416/97 R |
| 5,735,335 | A | 4/1998 | Gilmore et al. | |
| 5,820,337 | A | 10/1998 | Jackson et al. | |
| 6,000,906 | A | 12/1999 | Draskovich | |
| 6,139,258 | A | 10/2000 | Lang, III et al. | |
| 6,164,912 | A | 12/2000 | Tabbita et al. | |
| 6,234,755 | B1 | 5/2001 | Bunker et al. | |
| 6,247,896 | B1 | 6/2001 | Auxier et al. | |
| 6,280,140 | B1 | 8/2001 | Soechting et al. | |
| 6,607,355 | B2 | 8/2003 | Cunha et al. | |
| 6,705,831 | B2 | 3/2004 | Draper | |
| 6,890,154 | B2 | 5/2005 | Cunha | |
| 6,896,487 | B2 | 5/2005 | Cunha et al. | |
| 6,913,064 | B2 | 7/2005 | Beals et al. | |
| 6,929,054 | B2 * | 8/2005 | Beals et al. | 164/369 |
| 6,932,145 | B2 | 8/2005 | Frasier et al. | |
| 6,932,571 | B2 | 8/2005 | Cunha et al. | |
| 6,955,522 | B2 | 10/2005 | Cunha et al. | |
| 6,994,521 | B2 | 2/2006 | Liang | |
| 7,014,424 | B2 | 3/2006 | Cunha et al. | |
| 7,097,424 | B2 | 8/2006 | Cunha et al. | |
| 7,097,425 | B2 | 8/2006 | Cunha et al. | |
| 7,108,045 | B2 | 9/2006 | Wiedemer et al. | |
| 7,131,818 | B2 | 11/2006 | Cunha et al. | |
| 7,137,776 | B2 | 11/2006 | Draper et al. | |
| 7,172,012 | B1 | 2/2007 | Memmen | |
| 7,174,945 | B2 | 2/2007 | Beals et al. | |
| 7,185,695 | B1 | 3/2007 | Santeler | |
| 7,216,689 | B2 | 5/2007 | Verner et al. | |
| 7,217,094 | B2 | 5/2007 | Cunha et al. | |
| 7,217,095 | B2 | 5/2007 | Pietraszkiewicz et al. | |

(Continued)

FOREIGN PATENT DOCUMENTS

EP 207799 A2 * 1/1987

(Continued)

*Primary Examiner* — Matthew W Such
(74) *Attorney, Agent, or Firm* — Carlson, Gaskey & Olds, P.C.

(57) ABSTRACT

A turbine engine airfoil includes an airfoil structure having an exterior surface and an end portion. A cooling passage extends a length radially within the structure in a direction toward the end portion. The cooling passage provides a convection surface along the length adjacent to the exterior surface. The convection surface includes a generally uniform width along the length. The cooling passage has generally decreasing cross-sectional areas along the length in the direction.

9 Claims, 2 Drawing Sheets

U.S. PATENT DOCUMENTS

| | | | | |
|---|---|---|---|---|
| 7,220,103 | B2 | 5/2007 | Cunha et al. | |
| 7,255,536 | B2 | 8/2007 | Cunha et al. | |
| 7,258,156 | B2 | 8/2007 | Santeler | |
| 7,270,170 | B2 | 9/2007 | Beals et al. | |
| 7,302,990 | B2 | 12/2007 | Bunker et al. | |
| 7,303,375 | B2 | 12/2007 | Cunha et al. | |
| 7,306,024 | B2 | 12/2007 | Beals et al. | |
| 7,306,026 | B2 | 12/2007 | Memmen | |
| 7,311,497 | B2 | 12/2007 | Sharma et al. | |
| 7,311,498 | B2 | 12/2007 | Cunha et al. | |
| 7,322,795 | B2 | 1/2008 | Luczak et al. | |
| 7,343,960 | B1 | 3/2008 | Frasier et al. | |
| 7,364,405 | B2 | 4/2008 | Cunha et al. | |
| 7,377,746 | B2 * | 5/2008 | Brassfield et al. | 416/97 R |
| 2003/0021686 | A1 * | 1/2003 | Anding et al. | 416/95 |
| 2005/0156361 | A1 | 7/2005 | Holowczak et al. | |
| 2006/0107668 | A1 | 5/2006 | Cunha et al. | |
| 2006/0239819 | A1 | 10/2006 | Albert et al. | |
| 2007/0048122 | A1 | 3/2007 | Van Suetendael, IV et al. | |
| 2007/0048128 | A1 | 3/2007 | Cunha et al. | |
| 2007/0048134 | A1 | 3/2007 | Cunha et al. | |
| 2007/0104576 | A1 | 5/2007 | Cunha et al. | |
| 2007/0147997 | A1 | 6/2007 | Cunha et al. | |
| 2007/0172355 | A1 | 7/2007 | Cunha et al. | |
| 2007/0177976 | A1 | 8/2007 | Cunha et al. | |
| 2007/0224048 | A1 | 9/2007 | Abdel-Messeh et al. | |
| 2007/0227706 | A1 | 10/2007 | Lutjen et al. | |
| 2007/0248462 | A1 | 10/2007 | Lutjen et al. | |
| 2007/0286735 | A1 | 12/2007 | Cunha et al. | |
| 2008/0008599 | A1 | 1/2008 | Cunha et al. | |
| 2008/0019839 | A1 | 1/2008 | Cunah et al. | |
| 2008/0019840 | A1 | 1/2008 | Cunha | |
| 2008/0019841 | A1 | 1/2008 | Cunha | |
| 2008/0056909 | A1 | 3/2008 | Cunha et al. | |
| 2008/0107519 | A1 * | 5/2008 | Ahmad | 415/115 |
| 2009/0297361 | A1 * | 12/2009 | Dahmer et al. | 416/97 R |

FOREIGN PATENT DOCUMENTS

| | | |
|---|---|---|
| EP | 0 924 382 | 12/1998 |

* cited by examiner

AIRFOIL WITH TAPERED RADIAL COOLING PASSAGE

BACKGROUND

This disclosure relates to a supplemental radial cooling passage for an airfoil.

Turbine blades are utilized in gas turbine engines. As known, a turbine blade typically includes a platform having a root on one side and an airfoil extending from the platform opposite the root. The root is secured to a turbine rotor. Cooling circuits are formed within the airfoil to circulate cooling fluid, such as air. Typically, multiple relatively large cooling channels extend radially from the root toward a tip of the airfoil. Air flows through the channels and cools the airfoil, which is relatively hot during operation of the gas turbine engine.

Some advanced cooling designs use one or more radial cooling passages that extend from the root toward the tip. Typically, the cooling passages are arranged between the cooling channels and an exterior surface of the airfoil. The cooling passages provide extremely high convective cooling.

The Assignee of the present disclosure has discovered that in some cooling designs the airfoil is overcooled at the base of the airfoil near the platform. It is believed that strong secondary flows, particularly on the suction side, force the migration of relatively cool fluid off the end wall and onto the suction side of the blade. This results in relatively low external gas temperatures. Internally, the coolant temperature is relatively cool as it has just entered the blade. The high heat transfer coefficients provided by the cooling passage in this region are undesirable as it causes overcooling of the external surface and premature heating of the coolant air.

Tapered radial cooling passages have been used. However, in one arrangement, the wall adjacent to the suction side exterior surface is tapered as it extends towards the tip. This configuration undesirably results in increased cooling near the platform as compared to near the tip due to the larger convection surface near the platform.

In another arrangement in which the cross-sectional area of the cooling passage remains relatively constant cooling fluid, Mach numbers also remain relatively constant resulting in uniform heat transfer rates within the passage. Coolant fluid entering the airfoil at low temperature and increases in temperature as it moves through the cooling passage. External three-dimensional flows and non-uniform gas temperature profiles cause temperatures and heat transfer rates to be typically lower near the inner and outer radii of the airfoil. This external heat load, combined with the cool coolant fluid near the inlet to the airfoil cause the external surface to be overcooled.

What is needed is a radial cooling passage that provides desired cooling of the airfoil.

SUMMARY

A turbine engine airfoil is disclosed that includes an airfoil structure having an exterior surface and an end portion. A cooling passage extends a length radially within the structure in a direction toward the end portion. The cooling passage provides a convection surface along the length adjacent to the exterior surface. The convection surface includes a generally uniform width along the length. The cooling passage has generally decreasing cross-sectional areas along the length in the direction. The width and the cross-sectional areas are generally perpendicular to the length.

The cooling passage is provided by a core structure that extends from a first end to a second end along the length. The core structure includes a side having a generally uniform width along the length. The core structure includes a first thickness at the first end providing with the width a first area that is greater than a second area, which is provided by the width and a second thickness at the second end. Accordingly, a radial cooling passage provides desired cooling of the airfoil.

These and other features of the disclosure can be best understood from the following specification and drawings, the following of which is a brief description.

DETAILED DESCRIPTION

Figure 1:
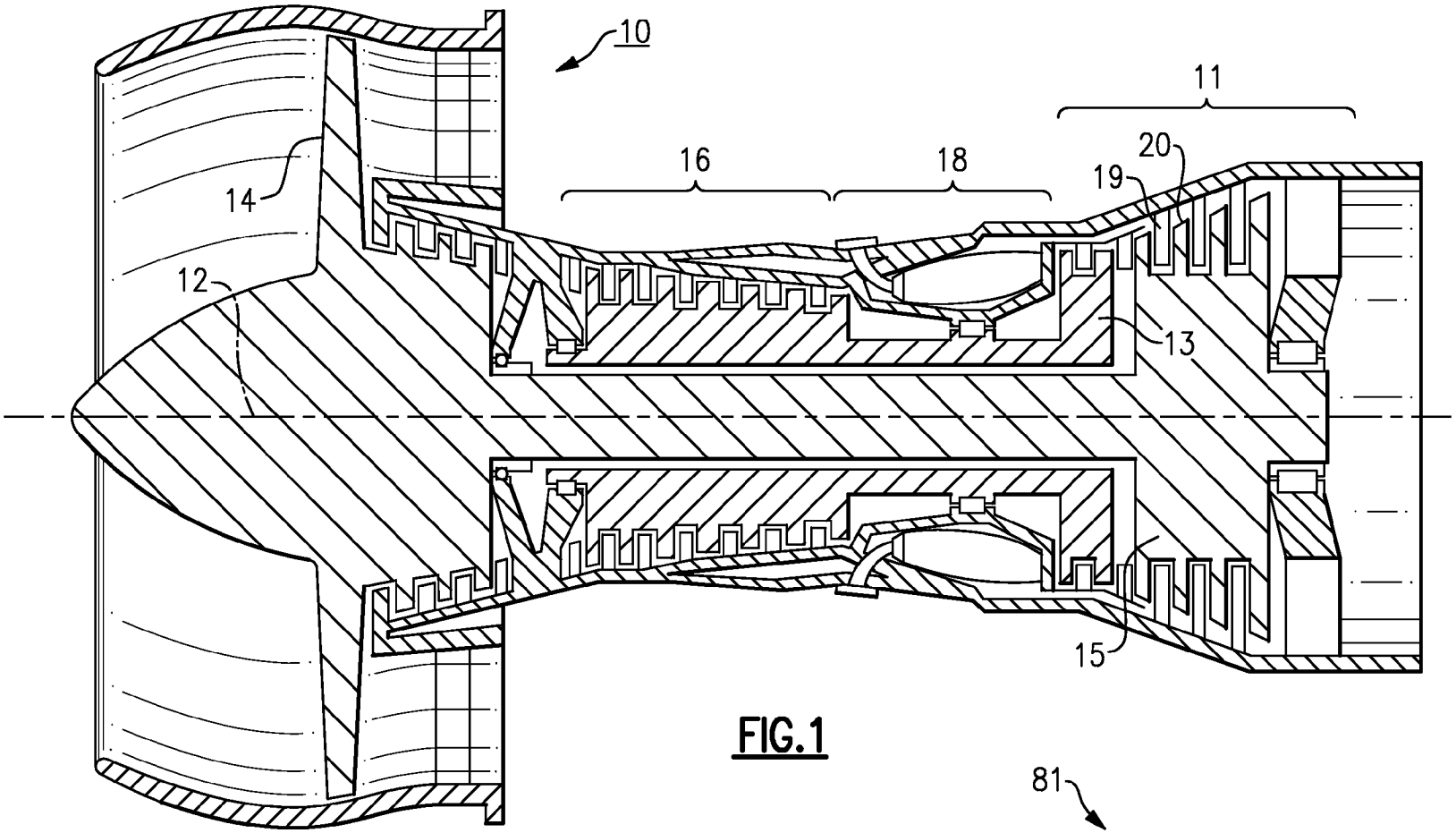
FIG. 1 is a schematic of a gas turbine engine incorporating the disclosed airfoil.

FIG. 1 schematically illustrates a gas turbine engine 10 that includes a fan 14, a compressor section 16, a combustion section 18 and a turbine section 11, which are disposed about a central axis 12. As known in the art, air compressed in the compressor section 16 is mixed with fuel that is burned in combustion section 18 and expanded in the turbine section 11. The turbine section 11 includes, for example, rotors 13 and 15 that, in response to expansion of the burned fuel, rotate, which drives the compressor section 16 and fan 14.

The turbine section 11 includes alternating rows of blades 20 and static airfoils or vanes 19. It should be understood that FIG. 1 is for illustrative purposes only and is in no way intended as a limitation on this disclosure or its application.

Figure 2:
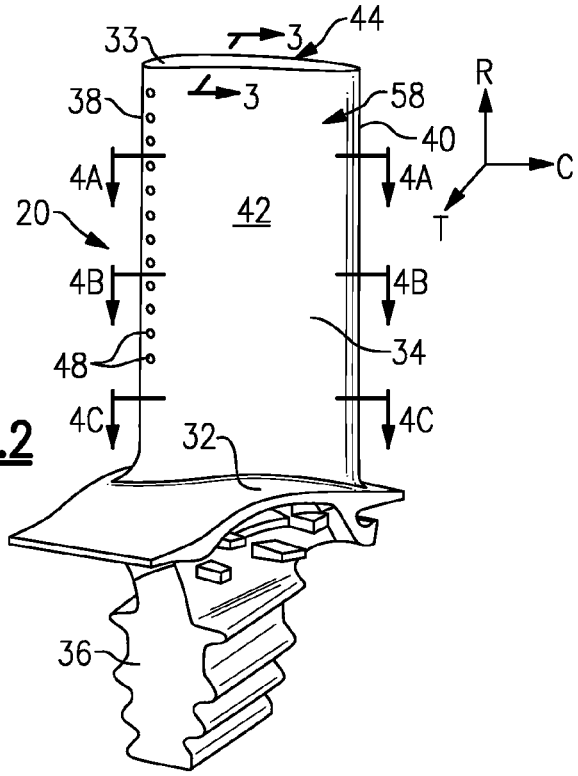
FIG. 2 is the airfoil having a tapered radial cooling passage.

An example blade 20 is shown in FIG. 2. The blade 20 includes a platform 32 supported by a root 36, which is secured to a rotor. An airfoil 34 extends radially outwardly from the platform 32 opposite the root 36. While the airfoil 34 is disclosed as being part of a turbine blade 20, it should be understood that the disclosed airfoil can also be used as a vane.

The airfoil 34 includes an exterior surface 58 extending in a chord-wise direction C from a leading edge 38 to a trailing edge 40. The airfoil 34 extends between pressure and suction sides 42, 44 in a airfoil thickness direction T, which is generally perpendicular to the chord-wise direction C. The airfoil 34 extends from the platform 32 in a radial direction R to an end portion or tip 33. Cooling holes 48 are typically provided on the leading edge 38 and various other locations on the airfoil 34 (not shown).

Figure 4A:
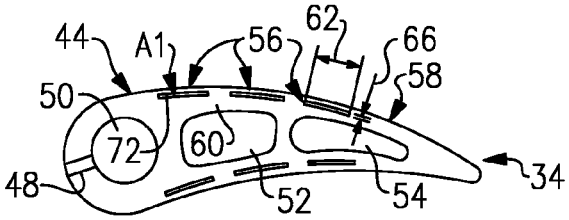
FIG. 4A is a cross-sectional view of the airfoil shown in FIG. 2 taken along line 4A-4A.
Figure 4B:
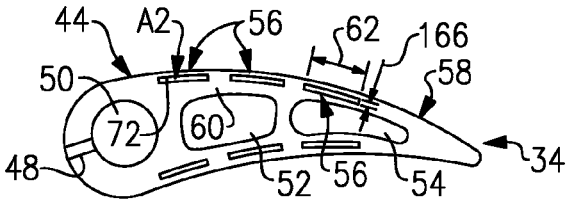
FIG. 4B is a cross-sectional view of the airfoil shown in FIG. 2 taken along line 4B-4B.
Figure 4C:
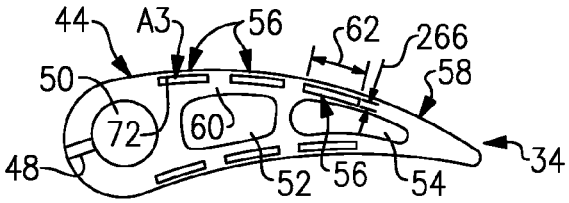
FIG. 4C is a cross-sectional view of the airfoil shown in FIG. 2 taken along line 4C-4C.
Figure 3:
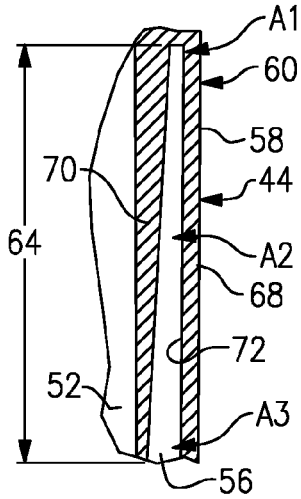
FIG. 3 is a cross-sectional view of the airfoil shown in FIG. 2 taken along line 3-3.

Referring to FIGS. 4A-4C, multiple, relatively large radial cooling channels 50, 52, 54 are provided internally within the airfoil 34 to deliver airflow for cooling the airfoil. The cooling channels 50, 52, 54 typically provide cooling air from the root 36 of the blade 20.

Current advanced cooling designs incorporate supplemental cooling passages arranged between the exterior surface 58 and one or more of the cooling channels 50, 52, 54. In the example disclosed, a radially extending cooling passage 56 is provided in a wall 60 between the exterior surface 58 and the cooling channels 50, 52, 54 at the suction side 44. First and second wall portions 68, 70 are provided on either side of the radial cooling passage 56 respectively adjacent to the exterior surface 58 and the cooling channel 52. However, it should be understood that the example cooling passages can be provided at other locations within the airfoil. For example, the disclosed cooling passage 56 can also be provided on the pressure side (shown) and leading edge (not shown).

As shown in FIG. 3 and FIGS. 4A-4C, the radial cooling passages 56 tapers along a length 64 from the platform 32 to the tip 33. A width 62 of the radial cooling passage 56 remains generally constant or uniform along the length 64. As a result, a convection surface 72 that is provided adjacent to the exterior surface 58 remains generally uniform along the length 64. The convection surface 72 provides a generally flat surface in one example. The convection surface 72 may include heat transfer augmentation features, such as trip strips, pin fins and/or dimples, for example. In the example, the cross-sectional areas of the radial cooling passage 56 are generally rectangular in shape and may include large fillets at the corners. The cooling passage 56 can also be a tapered, round passage. Areas A1, A2, A3 along the length 64 respectively include thicknesses 66, 166, 266 that are respectively shown in FIGS. 4A-4C. The thicknesses 66, 166, 266 are substantially less than the width 62. The thicknesses 66, 166, 266 and width 62 are substantially less than the length 64.

Figure 5:
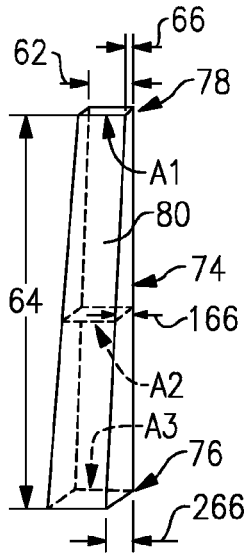
FIG. 5 is a schematic view of a portion of an example core structure for providing the radial cooling passage.

In one example, the cooling channels 50, 52, 54 are provided by ceramic cores during a casting process, as known. The radial cooling passages 56 are provided by a refractory metal core 74 (FIG. 5), for example. The taper of the core structure 80 can be provided by 3D-rolling, grinding, chemical machining or any other suitable method of reducing the thickness. The core structure 80 tapers from a first end 76 to a second end 78 to provide a shape with dimensions corresponding to the radial cooling passages 56.

Figure 6:
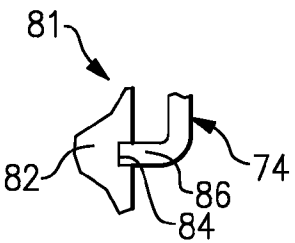
FIG. 6 is a partial cross-sectional view of a portion of the core structure cooperating with a second core structure, which provides a cooling channel.

Referring to FIG. 6, a core assembly 81 can be provided in which a portion 86 of the core structure 80 is received in a recess 84 of a ceramic core 82. In this manner, the resultant radial cooling passage 56 provided by the core structure 80 is in fluid communication with a corresponding cooling channel 50, 52, 54 subsequent to the airfoil casting process.

The reduction in the cross-sectional area increases the Mach number as the coolant moves to the end of the coolant passage. The increase in Mach number in turn allows the heat transfer coefficient near the exit of the passage to be higher than near the inlet. The heat transfer coefficients in the region of the blade 20 near the platform 32 is reduced. This allows the designer to maintain a uniform value (or adjust to the most desirable value) based upon the product of $h*(\Delta T)$ resulting in a uniformly cooled blade, where h is the convection heat transfer coefficient and $\Delta T$ is the temperature gradient.

Although example embodiments have been disclosed, a worker of ordinary skill in this art would recognize that certain modifications would come within the scope of the claims. For that reason, the following claims should be studied to determine their true scope and content.

What is claimed is:

1. A turbine engine airfoil comprising:

an airfoil structure having an exterior surface and an end portion, and a cooling passage extending a length radially within the structure in a direction towards the end portion, a wall portion provided between the cooling passage and the exterior surface, the cooling passage providing a convection surface on the wall portion along the length adjacent to the exterior surface, the convection surface including a generally uniform width along the length in an airfoil chord-wise direction, and the cooling passage having generally decreasing cross-sectional areas along the length in the direction, the width and the cross-sectional areas are generally perpendicular to the length, wherein the convection surface is generally fiat, and the cross-sectional areas are generally rectangular in shape, the wall portion having a uniform thickness in an airfoil thickness direction extending from a root toward a tip of the airfoil structure.

2. The turbine engine airfoil according to claim 1, comprising a cooling channel and a wall arranged between the cooling channel and the exterior surface with the cooling passage disposed in the wall.

3. The turbine engine airfoil according to claim 2, wherein the cooling channel and the cooling passage are in fluid communication with one another.

4. The turbine engine airfoil according to claim 2, wherein the cooling passage separates the wall into first and second wall portions, with the first wall portion arranged between the cooling passage and the exterior surface.

5. The turbine engine airfoil according to claim 4, wherein the exterior surface includes a suction side, the convection surface arranged adjacent to the suction side.

6. The turbine engine airfoil according to claim 1, wherein the cross-sectional areas each include a thickness and the width, the thickness is substantially less than the width.

7. The turbine engine airfoil according to claim 6, wherein the thicknesses and the width are substantially less than the length.

8. The turbine engine airfoil according to claim 6, wherein the cooling passage includes first and second ends opposite one another, the second end closer to the end portion than the first end, the cross-sectional areas including first and second areas respectively arranged at the first and second ends and including first and second thicknesses respectively, the first area and first thickness respectively greater than the second area and second thickness.

9. The turbine engine airfoil according to claim 1, comprising a platform from which the airfoil structure extends to the end portion, and the root extending from the platform opposite the airfoil.

* * * * *